US008314553B2

(12) United States Patent
Corazza et al.

(10) Patent No.: US 8,314,553 B2
(45) Date of Patent: Nov. 20, 2012

(54) DISCHARGE LAMP

(75) Inventors: Alessio Corazza, Como (IT); Vincenzo Massaro, Albairate (IT); Stefano Paolo Giorgi, Biassono (IT)

(73) Assignee: Saes Getters S.p.A., Lainate (MI) (IT)

( * ) Notice: Subject to any disclaimer, the term of this patent is extended or adjusted under 35 U.S.C. 154(b) by 0 days.

(21) Appl. No.: 13/319,069

(22) PCT Filed: Apr. 12, 2011

(86) PCT No.: PCT/EP2011/055712

§ 371 (c)(1),
(2), (4) Date: Nov. 4, 2011

(87) PCT Pub. No.: WO2011/092349

PCT Pub. Date: Aug. 4, 2011

(65) Prior Publication Data

US 2012/0112631 A1 May 10, 2012

(30) Foreign Application Priority Data

Apr. 21, 2010 (IT) ..... MI2010A0679

(51) Int. Cl.
*H01J 61/20* (2006.01)
*H01J 61/26* (2006.01)

(52) U.S. Cl. ..... 313/565; 313/550; 313/556; 313/558; 313/559; 445/31; 445/41; 417/48; 417/51

(58) Field of Classification Search ..... None
See application file for complete search history.

(56) References Cited

U.S. PATENT DOCUMENTS

| | | | | |
|---|---|---|---|---|
| 4,157,485 | A | 6/1979 | Hokkeling | |
| 5,646,483 | A | 7/1997 | Myojo et al. | |
| 5,739,633 | A | 4/1998 | Biro et al. | |
| 5,798,618 | A | 8/1998 | Van Os | |
| 6,538,378 | B1 * | 3/2003 | Nakano | 313/571 |
| 2005/0231095 | A1 | 10/2005 | Beck et al. | |
| 2006/0071601 | A1 * | 4/2006 | Yamada et al. | 313/634 |
| 2006/0273724 | A1 * | 12/2006 | Kwong | 313/634 |
| 2010/0039041 | A1 * | 2/2010 | Tsuzuki et al. | 315/248 |

FOREIGN PATENT DOCUMENTS

| | | |
|---|---|---|
| EP | 0307037 | 3/1989 |
| JP | 58034555 | 3/1983 |
| JP | 63066841 | 3/1988 |
| WO | 02/097858 | 12/2002 |
| WO | 2006/070426 | 7/2006 |
| WO | 2007/038419 | 4/2007 |
| WO | 2008/107654 | 9/2008 |

OTHER PUBLICATIONS

PCT International Search Report for PCT/EP2011/055712 filed on Apr. 12, 2011 in the name of SAES Getters S.P.A.
PCT Written Opinion for PCT/EP2011/055712 filed on Apr. 12, 2011 in the name of SAES Getters S.P.A.

* cited by examiner

*Primary Examiner* — Ashok Patel
(74) *Attorney, Agent, or Firm* — Steinfl & Bruno LLP

(57) ABSTRACT

A discharge lamp comprising a holed metallic structure that serves as a support for an amalgam Bi—In—X—Hg, a method for controlling pressure of mercury within discharge lamps and a process for manufacturing of the lamps are described.

12 Claims, 4 Drawing Sheets

DISCHARGE LAMP

CROSS REFERENCE TO RELATED APPLICATIONS

This application is in the US National Stage application of PCT/EP2011/055712, filed on Apr. 12, 2011, which in turn, claims priority to Italian Patent Application No. MI2010A000679 filed on Apr. 21, 2010.

The present invention relates to an improved discharge lamp containing a holed metallic structure that serves as a support for a Bi—In—X—Hg amalgam, wherein X represents another metal suitably chosen. The invention also relates to a method for the control of the pressure of mercury within discharge lamps and to a process for the manufacturing of these lamps.

The invention is advantageously employed in the so-called low mercury pressure lamps, i.e. lamps wherein the pressure of mercury during operation is much lower than 1 bar. In particular, it is known that in many of these lamps, e.g. in most of linear and compact fluorescent lamps, in order to obtain the best performance it is preferable that the pressure of mercury is comprised between 0.5 and 1.5 Pa during lamp operation.

One of the main problems in the field is to dose the amount of mercury correctly, as well as to control the pressure of mercury that is established during the operation of the lamp. At pressure values that are too low in fact it is not possible to achieve an effective mechanism of radiative emission from the atoms of mercury that are excited, because these are in a small number, whereas an excessive mercury concentration in vapour phase leads the excited atoms to interact with one another through mechanisms such as auto-absorption of the radiation emitted and non-radiative energy transfer, thereby causing a reduction in the luminous flux of the lamp.

The ways in which mercury is initially dosed within a lamp are not an object of the present invention and mercury dosing is usually carried out in the field in different ways. For instance, mercury is dosed in form of liquid droplets, of vapours from a source external to the lamp, or by inserting amalgams that release mercury at a low temperature. Another solution that is particularly advantageous for introducing mercury into some types of lamps exploits one of the components of the lamp itself, such as an electrode shield, in order to support an alloy suitable to release mercury at a high temperature.

As mentioned above, it is very important to control the pressure of mercury over time to a correct value in order to optimize the luminous flux and the luminous efficiency of the lamp. One of the expedients employed in the field is the use of a control or working amalgam (the latter term making sense with reference to lamps in which the initial introduction of mercury is carried out by means of an amalgam or other suitable "primary" source). The advantages and improvements related to the use of a control amalgam are widely known in the field and described for example, in U.S. Pat. No. 4,157,485. In this document bismuth-indium amalgams are disclosed to control the amount of mercury within discharge lamps that operate at a low pressure. However, no particularly advantageous introduction methods and related restraints, e.g. in connection with temperature, are disclosed.

EP 0307037 discloses the use of In—Sn—Zn amalgams that are made to operate at temperatures higher than 105° C. in order to have the correct pressure of mercury within the lamp.

U.S. Pat. No. 5,798,618 discloses the use of various amalgams among which mercury amalgams generally based on indium, silver and In—Ag alloys that are employed in a wide temperature range and may even reach 340° C. The same type of amalgams, with specific reference to In—Ag amalgams, is disclosed in the publication JP 63-66841 and also in this case wide temperature ranges are mentioned.

US 2005/0231095 discloses a lamp that employs In—Ag, In—Sn or In—Cu as a control amalgam with the possible further addition of other elements, whose optimal range of temperatures is between 100° C. and 170° C. and that are used on a generic metallic support.

The possibility to use spherules of an amalgam based on Bi—In together with other optional elements instead disclosed in WO 2007/038419, wherein a thermal treatment of the amalgam at temperatures that are particularly high, up to 300° C., is also disclosed. However, the use of spherules of amalgams may limit the speed of interaction with mercury concerning both its sorption and release within the final device.

WO 2008/107654 instead discloses the use of Bi—Sn—In amalgams to control the pressure of mercury within discharge lamps. Also in this case operation temperatures that may have particularly high values, up to 170° C., are mentioned.

WO 2006/070426, in the applicant's name, discloses a manufacturing process of holed nets intended to support various active materials that are characterized by a low melting point, among which Bi—In alloys, with reference to their possible use as control amalgams within fluorescent lamps. However, this document does not teach an optimal use of these materials nor any temperature range concerning an effective use thereof in discharge lamps.

It is therefore an object of the present invention to optimize the introduction mode of amalgams in lamps in order to control the pressure of mercury during their operation, by exploiting a particular combination among the material, the type of support and its arrangement within the lamp, resulting in the temperature at which the support is heated during the operation of the lamp.

In a first aspect thereof the invention consists in a discharge lamp including a holed metallic structure, having each hole with a surface area not larger than 0.16 $mm^2$, wherein on said perforated strip an amalgam Bi—In—X—Hg is deposited, comprising at least 45% by weight of bismuth, the element X has a weight content comprised between 0 and 10% and is formed of one or more of the following elements: Sn, Ga, Ag, Au, Sb, Te, mercury is comprised in an amount between 0.3% and 12% by weight, and said holed metallic structure is arranged at a position in the lamp such that its working temperature is in the range between 60° C. and 95° C.

In a preferred embodiment, the surface areas of each one of the holes are not lower than 0.01 $mm^2$.

The term holed metallic structure envisions in its most common and functionally equivalent variants elements such as metallic nets, metallic meshes and perforated metallic strips.

In a preferred embodiment, the thickness of the holed metallic structure is comprised between 0.2 and 0.5 mm and, as to the material for its manufacturing, preferred is the use of nickel or nickel-plated iron.

At the beginning a composition not comprising mercury, that is generally called in the field "amalgamating material" or "master alloy", is deposited on the holed metallic structure and an amalgam is formed as a consequence of the introduction of mercury during the advanced steps of the manufacturing process of a lamp and of the interaction between said element with the master alloy.

The invention will be further described with reference to the following drawings.

Figure 4A:
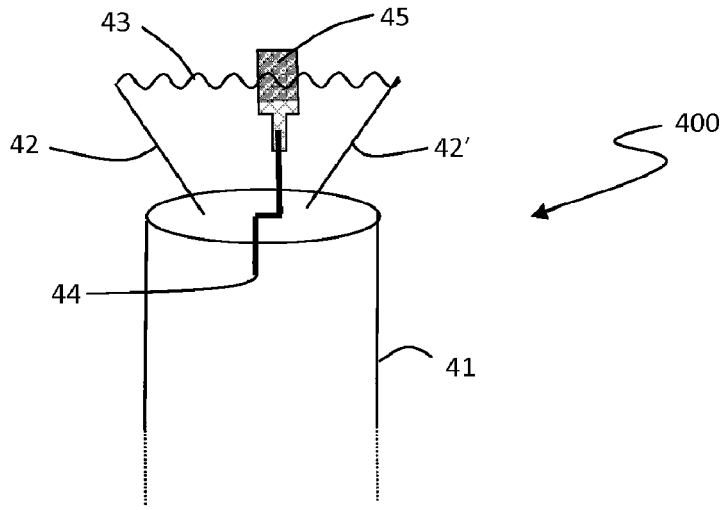
FIGS. 4A and 4B show details of lamps wherein a holed metallic structure according to the invention is mounted.
Figure 4B:
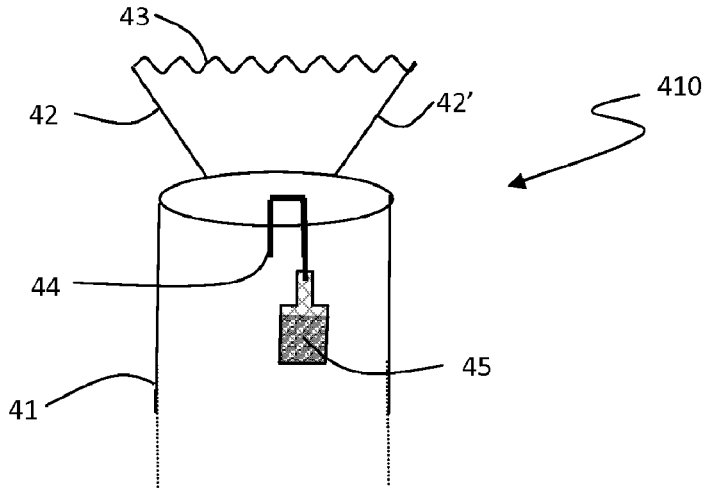

In the drawings, referring in particular to FIGS. 4A and 4B, the size and the dimensional ratios of the various members are not correct, but have been altered in order to improve the comprehensibility of the figures.

Figure 1A:
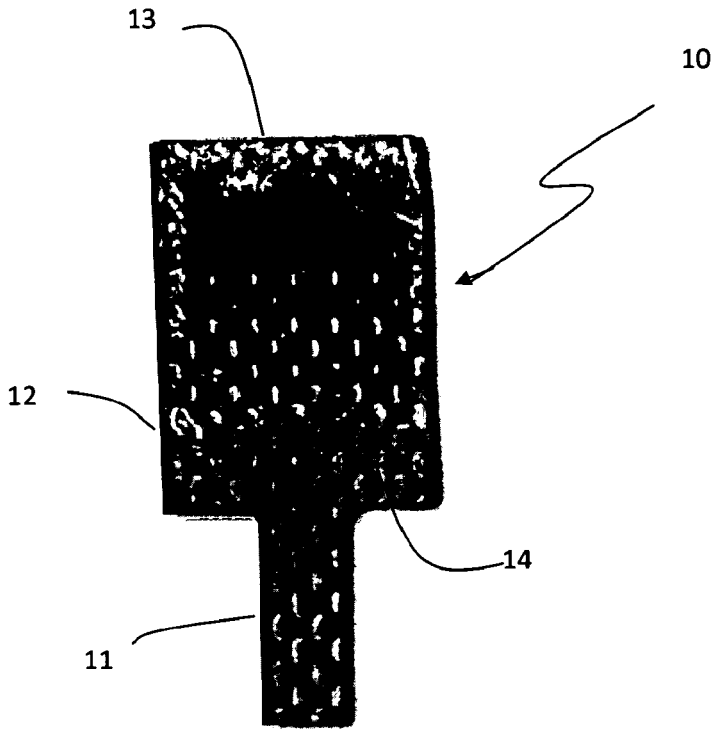
FIG. 1A shows a picture of a holed metallic structure supporting an amalgam according to the present invention and FIG. 1B shows a simplified graphic representation thereof.
Figure 1B:
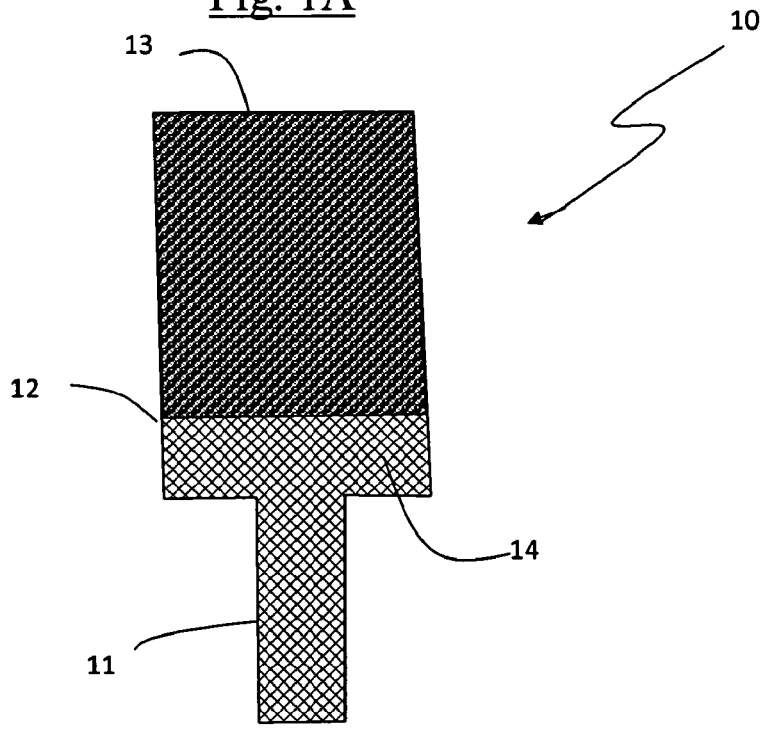

FIG. 1 shows a picture of a holed metallic structure supporting an amalgam according to the present invention. In this case the net 10 is T-shaped and comprises a thinner part 11 serving as a stem and a part 12 having a larger surface area, which is divided into two portions, namely a portion 13 on which a Bi—In amalgam is deposited and a portion 14 on which no amalgam is deposited. In order to improve the readability of the picture, FIG. 1B shows a graphic representation, which has been necessarily simplified, of the picture of FIG. 1A and maintaining the same reference numbers of the above-described elements.

The embodiment disclosed with reference to the figures above is particularly advantageous because it avoids interferences due to the presence of the master alloy during the fixing operations of the holed metallic structure that are typically carried out by welding. In particular, these interferences might occur also subsequently, as an effect of the transformation of the master alloy into an amalgam due to the exposure to mercury.

In particular, in a preferred embodiment the master alloy, and consequently the amalgam, after having been exposed to mercury, is arranged on at least the 50% of the surface area available on the holed metallic structure. In some cases it is preferable to have a portion free from the deposit of amalgam/master alloy.

This allows to use supports for the introduction of the master alloy/amalgam that are not excessively wide and bulky and at the same time to keep a portion of the support free from the master alloy/amalgam in order to allow an easier fixing of the holed metallic structure.

The purpose of FIG. 1 is to show a possible configuration, but other embodiments are possible and absolutely equivalent, provided that they are characterized by the use of a holed metallic structure having the above-mentioned dimensional features of the holes. For example, in another embodiment the geometry of the holed support may be different and the net may have holes that are not necessarily circular, but have other geometries that are absolutely equivalent, such as e.g. rhomboidal, rectangular or hexagonal.

Similarly, the geometry of the support may be of a different type and not limited to the T-shape shown in FIG. 1. In particular, other advantageous geometries are L-shaped and, more generally, any geometry having a thinner part corresponding to the part 11 in FIG. 1, which facilitates the fixing operations of the holed net inside the lamp.

The inventors have found that there is a very critical relationship between the size of the holes and the temperature at which the amalgam may be brought during the operation of the lamp, while avoiding the detachment of the deposit of material. This critical aspect tends to occur over time. The higher the temperature, the more is the amalgam softening, also considering that the amalgams must operate under such temperature conditions that a semi-liquid status of the material is at least partially reached, with the consequence that the amalgam tends to come out from the holes and detaches from the support. Therefore, holes having a surface area larger than 0.16 $mm^2$ cannot exploit the capillarity effect in order to effectively retain an amalgam that is in a softened or semi-liquid condition. Holes having a surface area lower than 0.01 $mm^2$ instead are not suitable because they can receive only limited amounts of material.

Figure 2A:
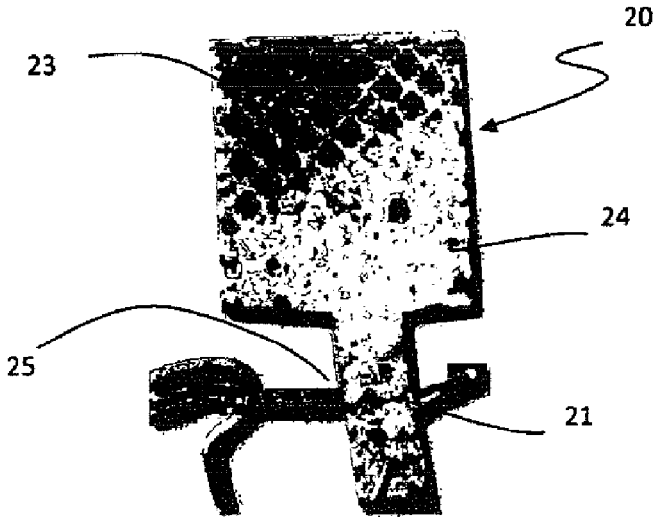
FIG. 2A is a comparative picture of a holed metallic structure supporting an amalgam that is not according to the present invention and FIG. 2B shows a simplified graphic representation thereof.
Figure 2B:
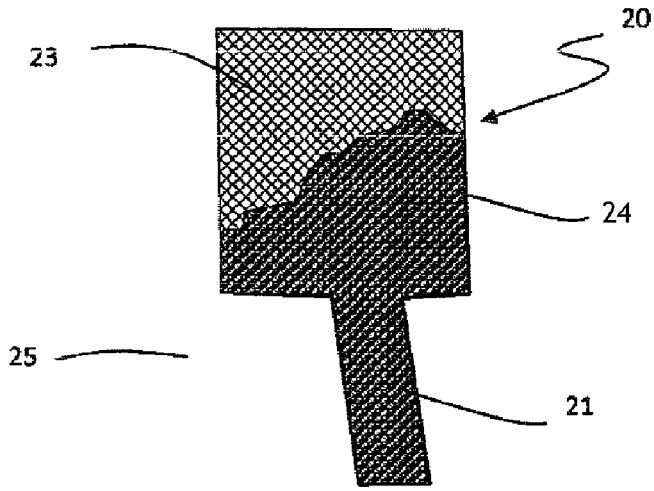

FIG. 2 shows a comparative example with a picture of a net 20 supporting a In—Ag—Hg amalgam after 170 hours of operation with heating cycles at 150° C., which is one of the preferred operation temperatures for this material (thermal cycle employed: 30 minutes at 150° C. and 30 minutes at room temperature). It may be clearly seen that a significant portion of the amalgam has moved from region 23 to both region 24 and tab 21, the latter being welded to a supporting hook 25. As it may be seen by comparing FIG. 2 with FIG. 1, at the beginning the portions 21 and 24 of the holed metallic structure were free from amalgam, whereas in these conditions the amalgam is also detached from the holed support. This phenomenon may negatively influence the operation of the lamp, because the lost fraction may result in blackening or obscuration phenomena, thus jeopardizing the quality of the luminous flux of the lamp, or the lost fraction may move towards cool regions of the lamp and thus lead to a bad control of the mercury pressure or to a loss of the amount of mercury in the vapour state, thereby causing a premature ageing of the lamp.

The temperature balance at which the holed metallic structure with the amalgam must operate is very important. It is necessary in fact that the amalgam is proximate to the electrode in order to be at a temperature sufficient to ensure an adequate mercury pressure, but at the same time this temperature must not be too high in order to avoid the above-mentioned problems mainly related to the detachment of the amalgam.

For this reason the invention is carried out by employing amalgams Bi—In—X—Hg comprising at least 45% by weight of bismuth and wherein the element X has a weight content comprised between 0 and 10% and is formed of one or more of the following elements: Sn, Ga, Ag, Au, Sb, Te.

Figure 3:
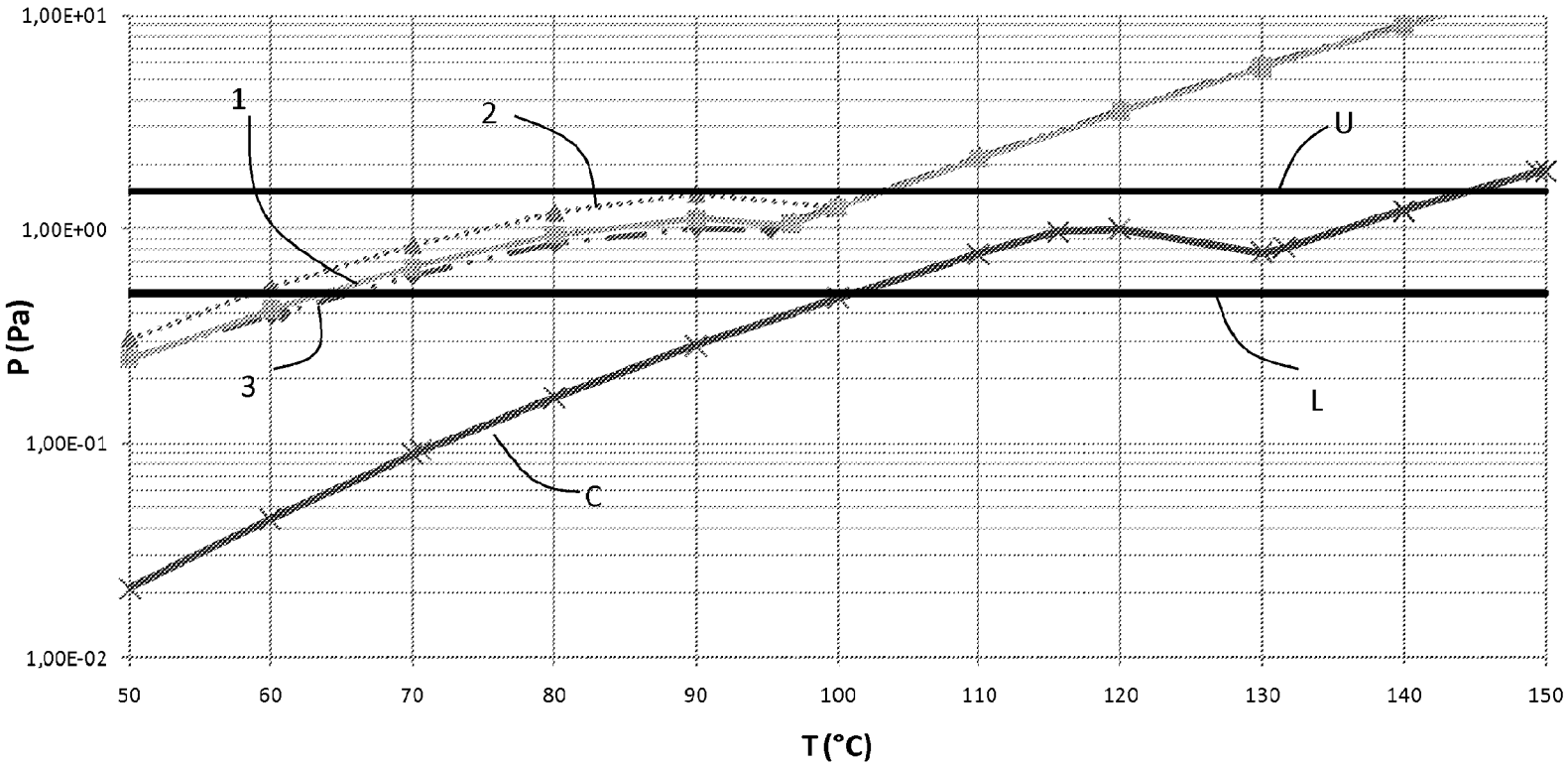
FIG. 3 shows a comparative graph of the equilibrium pressures of mercury with different types of amalgams as a function of temperature.

The advantages deriving from the use of this type of amalgams can be observed on the semi-log graph of the partial pressure of mercury as a function of the temperature, shown in FIG. 3, which sets forth the data obtained from a holed net on which the following amalgams are present:

Bi 61.1%—In 32.9%—Hg 6%: continuous curve 1;

Bi 60.45%—In 32.55%—In 1%—Hg 6%: dotted curve 2;

Bi 60.45%—In 32.55%—Ga 1% Hg 6%: dash-dot curve 3; and

In 88.4%—Ag 5.6%—Hg 6%: comparative curve c.

The horizontal lines L and U show instead the limits of the optimal pressure range for the correct operation of the lamp.

As it may be observed in FIG. 3, the optimal pressure with the comparative amalgam is obtained at temperatures not lower than 100° C. and centred around 115° C., but at these temperatures there is the starting of the occurrence of the above-mentioned problems related to the significant softening of the amalgam and to its movement inside the lamp consequent to the percolation phenomena, as shown in FIG. 2. Useful amalgams for carrying out the present invention instead have a temperature range of use centred around 80° C. and comprised between 60° C. and 95° C. and therefore do not show this kind of problems.

Within the family of amalgams Bi—In—X—Hg, the amalgams according to the present invention also have a further advantage, i.e. the ability to bind large amounts of mercury, even larger than 5%, which allows to introduce a lower amount of material in order to control the mercury pressure inside the lamp. This allows to reduce the problems related to the size of the support, thus facilitating its introduction and minimizing its shielding effect.

In particular Bi—In—X compounds comprising at least 45% by weight of bismuth and wherein X has a weight content not higher than 10% and is formed of one or more of the following elements: Sn, Ga, Ag, Au, Sb, Te, have characteristics in terms of amalgamated mercury amounts that are similar to the amalgams produced by starting from In—Ag compounds with the advantage to be able to operate at a lower temperature. Moreover, these amalgams have characteristics that are remarkably higher in terms of mercury amounts that can be bound with respect to those described in WO 2008/017654, i.e. amalgams obtained by starting from master alloys Bi—Sn—In which have a high percentage of tin.

FIGS. 4A and 4B show some possible ways to insert the holed nets within low pressure discharge lamps.

In particular, FIG. 4A schematically shows a portion of a lamp 400 wherein is represented a glass stem 41 on which are present two wires 42, 42', supporting the electrode, a tungsten filament 43 being typically covered with a coating (not shown) made of an emitting material based on oxides. While the two members 42, 42' serve to both support and supply current to the tungsten filament in order to cause it to emit electrons, a third metallic member 44 also extends from the stem. This member is usually called in the field "third electrode" and has the only purpose of supporting other members, in this case the holed metallic structure carrying the control amalgam. In FIG. 4A the holed metallic structure is arranged close to the tungsten filament, whereas in FIG. 4B the third electrode is so bent to bring the control amalgam away from the discharge region of the lamp.

Either these different solutions are employed according to the maximum power of the lamp, that is also called in the field "nominal power". In lamps having a low nominal power in fact it is possible and preferable to arrange the holed metallic structure supporting the control amalgam proximate to the electrode and the discharge region, because this does not cause an excessive heating of the amalgam. On the contrary, this is not possible with lamps having a high maximum power, wherein it is advisable to use the arrangement shown in FIG. 4B in order to avoid to overheat the active material.

Those shown in FIGS. 4A and 4B are two preferred and non-limiting embodiments allowing to arrange correctly, i.e. at the correct distance, the holed metallic structure containing the control amalgam with respect to the discharge region and the lamp electrode in order to achieve the proper working temperature.

It is important to stress that these drawings are extremely schematic and simplified and show only the members that are strictly necessary to characterize the invention. For example, the pumping tubulation with the related connecting hole provided on the glass stem for the evacuation of the lamp and the glass tube of the lamp have not been shown, as well as possible tapering portions or particular geometries of the glass stem, or optional members such as shielding members for the electrode.

In particular, the optimal distance, i.e. the minimum distance between the edge of the metallic holed net and the central portion of the filament, depends on the maximum power (in the field usually called nominal power) of the lamp and must be greater than a distance d in millimeters calculated through the following formula:

$$d=0.042*P+5.250$$

wherein P is the nominal power of the lamp expressed in Watt.

The wording "maximum power" refers to, as mentioned above, the nominal power also when the lamps are operated at a variable power and brightness through suitable regulators. The support of the control amalgam must be arranged at such a distance to ensure that no material loss occurs at the maximum operation power of the lamp.

In a second aspect thereof the invention relates to a method for the control of mercury within discharge lamps by means of a holed metallic structure with the surface of each hole having an area not larger than 0.16 $mm^2$, wherein on said net an amalgam Bi—In—X—Hg is deposited, comprising at least 45% by weight of bismuth, the element X has a weight content comprised between 0 and 10% and is formed of one or more of the following elements: Sn, Ga, Ag, Au, Sb, Te, and with a mercury amount comprised between 0.3% and 12%, and said holed net is arranged at a position of the lamp such that its temperature is in the range between 60° C. and 95° C.

In a preferred embodiment, the amount of mercury in the amalgam Bi—In—X—Hg is at least 5%.

In a third aspect thereof the invention relates to a process for the manufacturing of discharge lamps, comprising inserting and fixing at a given position of the lamp a holed metallic structure with the surface of each hole having area not larger than 0.16 $mm^2$, wherein on said net a master alloy Bi—In—X—Hg is deposited, comprising at least 45% by weight of bismuth, the element X has a weight content comprised between 0 and 10% and is formed of one or more of the following elements: Sn, Ga, Ag, Au, Sb, Te; a subsequent exposure to mercury being provided with consequent transformation of the master alloy into an amalgam comprising an amount of mercury between 0.3% and 12%.

The invention claimed is:

1. A discharge lamp comprising a holed metallic structure, each hole having a surface area less than or equal to 0.16 $mm^2$, wherein on said holed metallic structure an amalgam Bi—In—X—Hg is deposited, the amalgam comprising:

at least 45% by weight of bismuth, between 0 and 10% by weight of X, wherein X comprises at least one element selected from the group consisting of: Sn, Ga, Ag, Au, Sb, Te, and between 0.3% and 12% by weight of mercury, wherein said holed metallic structure is arranged at a position of the lamp such that a working temperature of the holed metallic structure is between 60° C. and 95° C.

2. The discharge lamp according to claim 1, wherein said amalgam comprises 5% or more by weight of mercury.

3. The discharge lamp according to claim 1, wherein said surface area for each hole of the holed metallic structure is greater than or equal to 0.01 $mm^2$.

4. The discharge lamp according to claim 1, wherein said holed metallic structure has a thickness between 0.2 and 0.5 mm.

5. The discharge lamp according to claim 1, wherein said holed metallic structure comprises nickel or nickel-plated iron.

6. The discharge lamp according to claim 1, wherein said holed metallic structure has a T shape.

7. The discharge lamp according to claim 1, wherein said holed metallic structure is placed in such a position that a minimum distance between an edge of the holed metallic structure and the central portion of a filament of said lamp is greater than a distance (d) in millimeters defined in a function of a nominal power (P) of said lamp when expressed in Watts through the formula d=0.042*P+5.250.

8. The discharge lamp according to claim 1, wherein said amalgam is deposited on at least 50% of the surface of said holed metallic structure.

9. The discharge lamp according to claim 1, wherein at least the 10% of the surface of said holed metallic structure is free of said amalgam.

10. A method for mercury control within discharge lamps, the method comprising:

providing a holed metallic structure, each hole having a surface area less than or equal to 0.16 $mm^2$, depositing an amalgam Bi—In—X—Hg on said holed metallic structure, the amalgam comprising:

at least 45% by weight of bismuth, between 0 and 10% by weight of X, wherein X comprises at least one element selected form the group consisting of: Sn, Ga, Ag, Au, Sb, Te, and between 0.3% and 12% by weight of mercury, and arranging said holed metallic structure at a position of the lamp such that a working temperature of the holed metallic structure is between 60° C. and 95° C.

11. The method according to claim 10, wherein the amalgam comprises 5% or more by weight of mercury.

12. A process for manufacturing discharge lamps, comprising:

inserting and fixing at a given position of the discharge lamp, a holed metallic structure, each hole of the holed metallic structure having a surface area less than or equal to 0.16 $mm^2$, depositing on said holed metallic structure a master alloy Bi—In—X—Hg, the master alloy comprising:

at least 45% by weight of bismuth, and between 0 and 10% by weight of X, comprises at least one element selected from the group consisting of: Sn, Ga, Ag, Au, Sb, Te, and subsequently exposing the master alloy to mercury to transform the master alloy into an amalgam comprising an amount of mercury between 0.3% and 12%.

* * * * *